US008690018B2

(12) United States Patent
van der Heijden et al.

(10) Patent No.: US 8,690,018 B2
(45) Date of Patent: Apr. 8, 2014

(54) WALL MOUNTABLE DISPENSER AND METHOD OF DISPENSING MATERIAL

(75) Inventors: Lambertus van der Heijden, Bunnik (NL); Arnoud Gengler, De Wijk (NL); Bekie Riley, Derby (GB)

(73) Assignee: Diversey, Inc., Sturtevant, WI (US)

( * ) Notice: Subject to any disclaimer, the term of this patent is extended or adjusted under 35 U.S.C. 154(b) by 44 days.

(21) Appl. No.: 13/318,414

(22) PCT Filed: May 4, 2010

(86) PCT No.: PCT/US2010/033500

§ 371 (c)(1), (2), (4) Date: Nov. 1, 2011

(87) PCT Pub. No.: WO2010/129519

PCT Pub. Date: Nov. 11, 2010

(65) Prior Publication Data

US 2012/0048892 A1 Mar. 1, 2012

(51) Int. Cl.
*B67D 7/06* (2010.01)

(52) U.S. Cl.
USPC ..... 222/181.1; 222/183; 222/214

(58) Field of Classification Search
USPC ..... 215/395, 399; 220/476, 480, 481, 751; 222/23, 180, 181.1, 181.2, 181.3, 182, 222/183, 164, 167, 206, 212, 214; 248/202.1, 316.8, 222.11, 222.12, 248/224.7

See application file for complete search history.

(56) References Cited

U.S. PATENT DOCUMENTS

| | | | | | |
|---|---|---|---|---|---|
| 780,938 | A | | 1/1905 | Clarke | |
| 1,072,940 | A | * | 9/1913 | Goppelt | 248/108 |
| 1,311,628 | A | | 7/1919 | Walsh | |
| 2,233,721 | A | * | 3/1941 | Ward | 222/164 |
| 2,255,158 | A | * | 9/1941 | Furrier | 222/164 |
| 2,614,700 | A | | 10/1952 | Kjeldsen | |
| 2,678,754 | A | | 5/1954 | Kirsner | |
| 3,926,347 | A | | 12/1975 | Low et al. | |
| 4,085,867 | A | | 4/1978 | Heller | |
| 4,166,553 | A | | 9/1979 | Fraterrigo | |

(Continued)

FOREIGN PATENT DOCUMENTS

| | | | | |
|---|---|---|---|---|
| DE | 3241146 | | 5/1983 | |
| DE | 3241146 | A1 * | 5/1983 | A47K 5/12 |

(Continued)

OTHER PUBLICATIONS

International Search Report prepared by the Korean Intellectual Property Office—date of completion Jan. 20, 2011.

*Primary Examiner* — Kevin P Shaver
*Assistant Examiner* — Patrick M Buechner
(74) *Attorney, Agent, or Firm* — Michael Best & Friedrich LLP

(57) ABSTRACT

A dispenser adapted for mounting to a surface is disclosed, and includes a bracket to which a container of material to be dispensed is connected. The bracket can have at least one arm to support the container and to which the container is releasably and rotatably connected. The container can be lifted by a user and squeezed to dispense material from the container. Alternatively, the container can be pressed by a user against the bracket to dispense the material. In some embodiments, the container is provided with a cover substantially covering a front surface of the container. The cover can be coupled to the bracket via the container.

13 Claims, 4 Drawing Sheets

(56) References Cited

U.S. PATENT DOCUMENTS

| | | | | |
|---|---|---|---|---|
| 4,470,523 | A | 9/1984 | Spector | |
| 4,565,303 | A | 1/1986 | Gilbertson | |
| 4,728,006 | A | 3/1988 | Drobish et al. | |
| 4,792,064 | A | 12/1988 | Loesel, Jr. et al. | |
| 4,905,873 | A | 3/1990 | Loesel et al. | |
| 4,921,136 | A | 5/1990 | Roggenburg, Jr. | |
| 5,014,880 | A | 5/1991 | Loesel, Jr. et al. | |
| 5,022,625 | A | 6/1991 | Klinkhardt | |
| 5,067,680 | A | 11/1991 | Miller | |
| 5,431,304 | A | 7/1995 | Gentile | |
| 5,638,989 | A * | 6/1997 | Ophardt et al. | 222/105 |
| D393,975 | S | 5/1998 | Bunschoten et al. | |
| D414,363 | S | 9/1999 | Daansen | |
| 5,947,338 | A | 9/1999 | Budsworth et al. | |
| 5,950,961 | A * | 9/1999 | Duck | 242/596.1 |
| 5,975,372 | A | 11/1999 | Heyn | |
| 6,152,330 | A | 11/2000 | Polan | |
| D448,958 | S | 10/2001 | Gross | |
| 6,325,245 | B1 * | 12/2001 | Matthews | 222/52 |
| 6,345,723 | B1 | 2/2002 | Blake et al. | |
| 6,695,174 | B2 | 2/2004 | Sorensen et al. | |
| 6,755,382 | B1 * | 6/2004 | Melnick | 248/316.8 |
| 6,808,090 | B2 | 10/2004 | Pedersen | |
| 6,964,354 | B2 | 11/2005 | Hernandez | |
| 6,991,133 | B2 | 1/2006 | Rutherford et al. | |
| D530,123 | S | 10/2006 | Ophardt et al. | |
| 7,261,221 | B2 | 8/2007 | Awbrey et al. | |
| D563,133 | S | 3/2008 | Kramer | |
| D568,660 | S | 5/2008 | Hodgson et al. | |
| D569,669 | S | 5/2008 | Nichols et al. | |
| D579,250 | S | 10/2008 | Cittadino et al. | |
| 8,544,695 | B2 * | 10/2013 | Gordon | 222/181.2 |
| 2003/0178443 | A1 * | 9/2003 | Pedersen | 222/181.3 |
| 2004/0206776 | A1 * | 10/2004 | Awbrey et al. | 222/105 |
| 2008/0083786 | A1 | 4/2008 | Marin | |
| 2012/0199609 | A1 * | 8/2012 | Schwenkenberg | 222/181.3 |
| 2013/0043276 | A1 * | 2/2013 | Hagleitner | 222/181.1 |
| 2013/0092708 | A1 * | 4/2013 | Geiberger | 222/153.03 |

FOREIGN PATENT DOCUMENTS

| | | |
|---|---|---|
| DE | 3333569 | 3/1985 |
| GB | 1351063 | 4/1974 |
| JP | 54-092875 | 7/1979 |
| WO | 98-22008 | 5/1998 |
| WO | 01/28397 | 4/2001 |
| WO | 01-28397 | 4/2001 |
| WO | 0128397 | 4/2001 |
| WO | 03-072450 | 9/2003 |

* cited by examiner

WALL MOUNTABLE DISPENSER AND METHOD OF DISPENSING MATERIAL

BACKGROUND

A wide variety of dispensers exist for dispensing various materials, including without limitation soap, disinfectant, sanitizer, and other dispensers, and dispensers adapted to dispense lotion, and perfume. Such dispensers can dispense material in any form. For example, such dispensers can be adapted to dispense gas, vapor, liquid, gel, foam, tablet, pellet, or other form in a metered or non-metered manner.

In many environments and applications, dispensers must meet requirements beyond simply dispensing material on demand. These requirements can relate to the cleanability, appearance, accessibility, and/or ease of use of the dispenser. For example, a number of existing dispensers are not acceptable for many environments due to the design of their housings, mounting brackets, and other elements. Many of these dispensers have complex designs with seams, apertures, and other features enabling buildup of dirt, dispensed material, and other matter, or which prevent the ability of cleaning personnel to adequately clean areas adjacent the dispensers. One such dispenser is disclosed in international patent application publication number WO/2001/028397, which discloses a dispenser design having a rear housing fixed to a wall and containing a reservoir of soap or disinfectant, and a cover plate covering the reservoir and rotatable with respect to the rear housing and the reservoir. In operation of the dispenser disclosed in WO/2001/028397, a user pushes against the cover plate to rotate the cover plate toward the rear housing to dispense soap. When the reservoir is empty, the cover plate is unlocked and rotated upward to remove and replace the reservoir, at which time the interior of the rear housing can be cleaned. The rear housing or cover plate of the dispenser disclosed in WO/2001/028397 can only be cleaned if the cover plate is unlocked and rotated away from the rear housing, thereby significantly increasing the difficulty of cleaning the dispenser and potentially making the dispenser unsuitable for many environments.

As another example, a number of dispensers do not present (and are not easily adaptable to present) a pleasing appearance to users, or have an appearance that cannot easily be changed. In many cases, the appearance of these dispensers cannot be changed to match the environment of the dispenser—a feature that is particularly important, for example, in hotel and restaurant bathrooms and in other locations where aesthetics are more relevant. With reference again to the dispenser disclosed in WO/2001/028397 by way of example only, no provision is made to enable a user to change the color or general appearance of the dispenser.

Also, a number of existing dispensers are not well suited in applications where different users may need to operate the dispensers in different manners. Some users (e.g., handicapped users, users who do not wish touch the dispenser with dirty hands, and the like) may need to operate a dispenser without the use of hands, whereas other users may wish to operate the dispenser by holding and squeezing the dispenser with one or more hands. The dispenser disclosed in WO12001/028397, along with many other available dispensers, fail to offer such versatility.

Accordingly, new dispenser designs continue to be welcome additions to the art.

SUMMARY

Some embodiments of the present invention provide a dispenser adapted for mounting on a surface, the dispenser comprising: a bracket having at least one arm extending in a direction away from the surface; and a container rotatably coupled to the arm a distance from the surface, the container having an exposed front facing generally away from the surface, a rear facing generally toward the surface, an exposed top and bottom extending between and connecting the front and rear of the container, exposed opposite sides extending between and connecting the front and rear of the container, and an outlet through which material from within the container is dispensed; the container having a rest position in which the container is oriented with the outlet facing in a substantially downward direction, the container pivotable with respect to the bracket toward and away from the rest position.

In some embodiments of the present invention, a dispenser adapted for mounting on a surface is provided, and comprises: a bracket having at least one arm extending in a direction away from the surface; a container rotatably coupled to the arm a distance from the surface; the container having a front facing generally away from the surface, a rear facing generally toward the surface, a top and bottom extending between and connecting the front and rear of the container, opposite sides extending between and connecting the front and rear of the container, and an outlet through which material from within the container is dispensed, the container releasably and rotatably coupled to the bracket via mating engagement between the container and the at least one arm of the bracket, the container having a rest position in which the container is oriented with the outlet facing in a substantially downward direction, the container pivotable with respect to the bracket toward and away from the rest position; and a cover coupled to the container and substantially covering the front of the container.

Some embodiments of the present invention provide a dispenser operable to contain and selectively dispense material, the dispenser comprising: a container including: a first end having at least one of a protrusion and a recess, a second end spaced from the first end and having an outlet, a front surface, a rear surface, and a cavity defined between the front and rear surfaces of the container and adapted to contain a material to be dispensed from the dispenser; a bracket including at least one of a recess and a protrusion matingly engaging the at least one of the protrusion and the recess of the container, respectively, to rotatably couple the container to the bracket and to support the container on a surface, the bracket further including a projection extending toward the container from the surface and supporting the container when pressed by a user; and a cover at least partially covering the container, the cover coupled to the container to lift the container upon rotation of the cover away from the bracket.

Some embodiments of the invention are directed towards a mounting system for securely mounting a selectively removable dispensable container to a surface. The mounting system comprises a container having a first projection and a second projection, wherein the first projection is aligned with the second projection to define an access of rotation for the container. The mounting system also comprises a bracket comprising a first arm having a recess for receiving the first projection and a second arm having a recess for receiving the second projection, wherein the first arm is selectively moveable away from the second arm. The mounting system also comprises a locking mechanism having a locked condition and an unlocked condition, wherein the locked condition fixes the distance between the first arm and the second arm and the unlocked condition allows the first arm to move away from the second arm. In some embodiments, the first arm is connected to the second arm via a telescoping mechanism, wherein the telescoping mechanism defines the movement between the arms.

Other aspects of the invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

Figure 1:
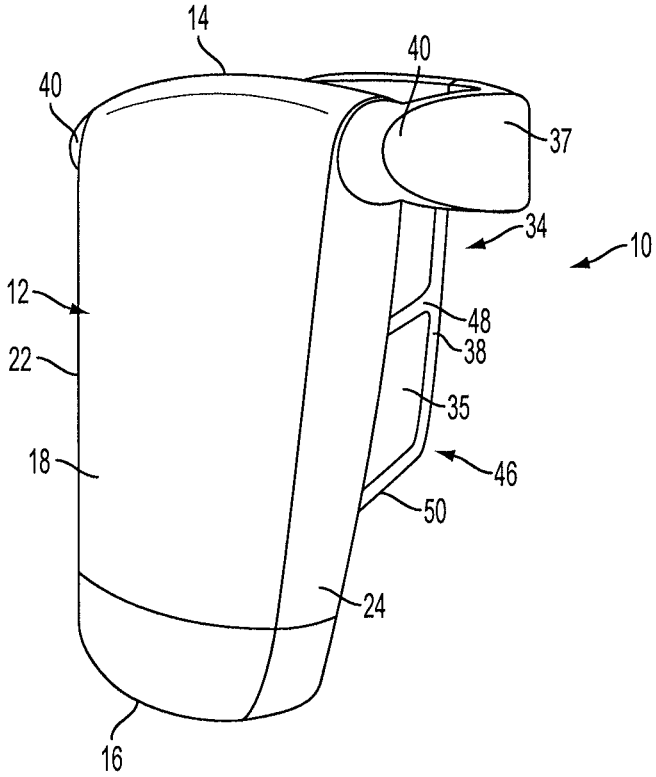
FIG. 1 is a perspective view of a dispenser according to an embodiment of the present invention.
Figure 2:
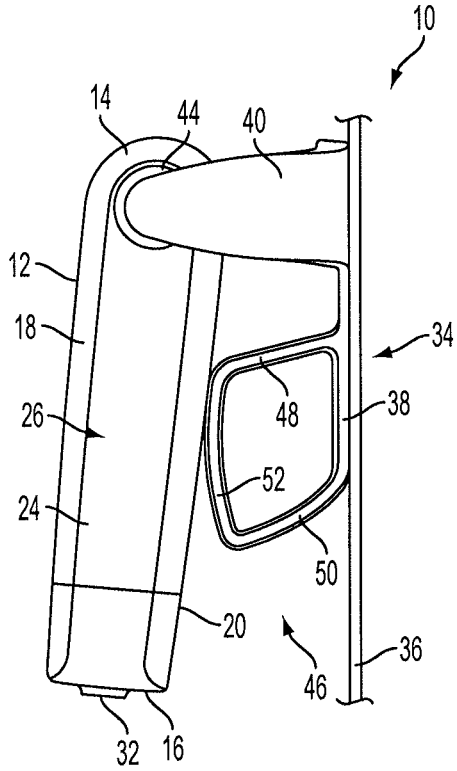
FIG. 2 is a side view of the dispenser of FIG. 1.

A first embodiment of a dispenser 10 is illustrated in FIGS. 1 and 2, and is operable to contain and selectively dispense one or more materials. The dispenser 10 illustrated in FIGS. 1 and 2 is adapted to dispense soap in liquid form, although the dispenser 10 can instead be adapted to dispense any other type of material in other forms, including without limitation materials such as disinfectants, sanitizers, shampoos, and other cleaning agents, conditioners, body oils, lotions, perfumes, and the like found in gaseous, vapor, liquid, gel, foam, tablet, pellet, or other form.

The dispenser 10 shown in FIGS. 1 and 2 includes a bracket 34 to which a container 12 is releasably and rotatably attached. A user can squeeze the container 12 by pressing against the container 12 or by rotating the container 12 to a position in which the user can squeeze the container 12 between the user's fingers, thereby dispensing fluid from within the container. The bracket 34 can be coupled to a wall, ceiling, countertop, or other surface to support the dispenser (and container 12) with respect thereto.

The dispenser 10 shown in FIGS. 1 and 2 includes a container 12 having a top surface 14, a bottom surface 16, a front surface 18, a rear surface 20, a first side surface 22 and a second side surface 24. The container 12 defines an internal cavity 26 adapted to hold at least one material be dispensed (shampoo, in the illustrated embodiment, by way of example only). The container 12 can comprise plastic, metal, or other material suitable for the material to be dispensed and the environment in which the dispenser 10 is to be used.

The container 12 illustrated in FIGS. 1 and 2 has a generally vertically elongated and rounded shape, although other container shapes are possible, and fall within the spirit and scope of the present invention. For example, the container 12 can be generally cylindrical, ovular, or rotund, can be triangular, pentagonal, or hexagonal, can have a parallelepiped or cuboid shape, can have a regular, irregular, symmetrical, or non-symmetrical shape, and the like. Accordingly, the terms "top", "bottom", "front", "rear", "first", and "second" as used herein to refer to the container 12 apply to all such container shapes The container 12 is shaped for mating engagement with the bracket 34 (described in greater detail below), and has one or more features adapted for this purpose. For example, the container 12 can have one or more projections or recesses shaped and dimensioned for mating engagement with the bracket 34. In some embodiments, the container 12 is rotatably coupled to the bracket 34, wherein the projection(s) or recess(es) is shaped to enable such relative rotation. By way of example only, the container 12 illustrated in FIGS. 1 and 2 has two projections 30 extending outwardly from the container 12 proximate the top surface 14 of the container 12. The projections 30 of the illustrated embodiment are substantially conical or frusto-conical in shape, and rotatably mate with apertures 44 of the bracket 34. However, other suitable projection shapes are possible for mating (and in some embodiments, rotatably mating) with apertures 44 of the bracket 34, including without limitation cylindrical, hemi-spherical, parallelepiped, and other regular or non-regular projection shapes.

Figure 4:
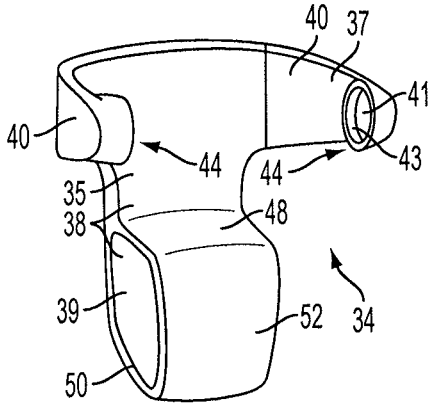
FIG. 4 is a perspective view of one embodiment of a bracket for the dispenser shown in FIG. 1.
Figure 5:
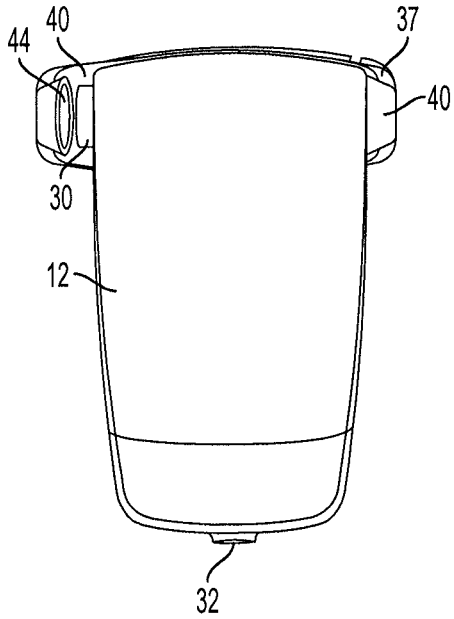
FIG. 5 is a perspective view of the bracket shown in FIG. 4 being coupled to a container.

In some embodiments, such as illustrated in FIGS. 4 and 5, the bracket 34 consists of two or more parts that are coupled together for movement to install and remove the bottle 12 from the bracket. In the embodiment illustrated in FIGS. 4 and 5, the bracket includes three parts (35, 37, 39). A first portion 35 of the bracket 34 is coupled to the wall. A second portion 37 of the bracket 34 is coupled to the first part of the bracket 34 via a sliding or telescoping interconnection. In the unlocked condition of the bracket 34, the second portion 37 can be moved in a telescoping manner relative to the first portion 35 to increase the width of the bracket by about 10 mm. In some embodiments, a spring mechanism is provided in the first portion to control the movement between the first and second portion. A release key can be used to unlock the bracket in some embodiments. When the spring is activated by the key, the locking mechanism is released and the second portion 37 of the bracket 34 will slide to the open position (FIG. 5), thus permitting a user to remove and refill or replace the bottle.

When the second portion 37 of the bracket 34 is pushed back into the first portion 35 manually (FIG. 4), the first and second portions are locked together in the closed position. The first and second portions are each provided with a first cylindrical recess 41 that is operable to receive a mating protrusion 30 of the bottle 12. The first and second portions can include a second cylindrical recess 43 in which the bottle 12 and cover 160 with corresponding protrusion (not shown) are received. The first and second cylindrical recesses 41, 43 have first and second diameters and extend for first and second depths. The first diameter is less than the second diameter, thereby allowing the bottle 12 to be coupled to the bracket 34 via the first cylindrical recesses 41, and allowing the bottle 12 and cover 160 to be coupled to the bracket 34 via the second cylindrical recesses 43. When the bottle 12 is coupled to the bracket 34, the bottle 12 can pivot with respect to the bracket 34 over about 180 degrees.

With continued reference to FIGS. 1 and 2, the illustrated container 12 is rotatably coupled to the bracket 34 proximate an upper end of the container 12, thereby enabling the container 12 to rotate about its upper end and enabling a user to orient the container 12 in a range of rotational positions for convenient dispensing operation. In some embodiments, the container 12 is coupled (e.g., rotatably coupled) to the bracket 34 at one or more locations at the upper half of the container 12 for this purpose. In other embodiments, however, the container 12 is coupled (e.g., rotatably coupled) to the bracket 34 at one or more locations at the bottom half of the container 12 for rotation about the bottom of the container 12. In still other embodiments, the container 12 is coupled (e.g., rotatably coupled) to the bracket 34 for rotation about a vertical axis, or about an axis that is skewed with respect to vertical and horizontal axes. In such embodiments, the locations at which the container 12 is coupled to the bracket 34 can be vertically displaced with respect to one another. By way of example only, the container 12 and bracket 34 illustrated in FIGS. 1 and 2 can be rotated 90 degrees (i.e., about an axis substantially orthogonal to the front surface 18 of the container 12), thereby enabling the container 12 to rotate about a substantially vertical axis rather than a substantially horizontal axis as illustrated.

The container 12 illustrated in FIGS. 1 and 2 also includes a dispensing outlet 32 positioned at or near the bottom surface 16 of the container 12, although the dispensing outlet 32 can be located in any other surface of the container 12 desired. When the container 12 is squeezed or pressed, or when the dispenser 10 is otherwise actuated, an amount of material contained within the internal cavity 26 is dispensed through the dispensing outlet 32. The dispensing outlet 32 also retains material within the internal cavity 26 when the container 12 is not squeezed or pressed, or when the dispenser 10 is otherwise not actuated. As used herein and in the appended claims, the term "actuate" (in its various forms) refers to any action causing dispense of material from the container 12, it being understood that there may be more than one way in which to "actuate" the same dispenser 10, as described in greater detail below.

In some embodiments, a consistent or substantially consistent volume of material 28 is dispensed from the container 12 upon actuation of the dispenser 10. In other embodiments, a variable volume of cleaning agent 28 can be dispensed from the container 12 upon actuation of the dispenser 10, such as by different amounts of force applied to the container 12 and/or by different lengths of actuation time.

The dispenser bracket 34 illustrated in FIGS. 1 and 2 can be coupled to a wall, partition, barrier, or any other mounting surface in any orientation desired, and in the illustrated embodiment is shown mounted with the dispensing outlet 32 at the bottom of the container 12 and with the projections 30 at the top of the container 12, wherein the container 12 is adapted to rotate about a substantially horizontal axis at the top of the container 12.

The bracket 34 shown in FIGS. 1 and 2 includes a plate 38 extending substantially parallel to a wall surface 36. The plate 38 can have any shape and size, and in the illustrated embodiment is substantially rectangular, extending from a location substantially horizontally spaced from the top surface 14 of the container 12 to a location horizontally and vertically spaced from the bottom surface 16 of the container 12. In other embodiments, the plate 38 can extend the entire length and/or width of the container 12, whereas in other embodiments, the plate 28 extends less than the entire length and/or width of the container 12.

The illustrated bracket 34 also includes at least one arm 40 extending from the plate 38 and away from the wall surface 36. The illustrated bracket 34 includes two arms 40 between which the container 12 is received. Each arm 40 has an aperture 44 shaped and dimensioned to receive a corresponding projection 30 of the container 12. The apertures 44 are each spaced from the plate 38 to permit rotation of the container 12 with respect to the bracket 34 (by virtue of the projections 30 rotating within the apertures 44.

The illustrated apertures 44 are substantially conical or frusto-conical in shape, and rotatably mate with the projections 30 of the container 12. However, other suitable aperture shapes are possible for mating (and in some embodiments, rotatably mating) with the projections 30 of the container 12, including without limitation cylindrical, hemi-spherical, parallelepiped, and other regular or non-regular projection shapes. In some embodiments, the projections 30 mate with a clearance fit within the apertures 44, whereas in other embodiments, the apertures 44 are substantially larger in one or more dimensions than the projections 30.

Although the container 12 of the dispenser 10 illustrated in FIGS. 1 and 2 has two projections 30 that rotatably mate with apertures 44 of the bracket 34, it will be appreciated that the locations of either or both projections 30 and apertures 44 can be reversed in other embodiments. Also, any number of mating projection and aperture pairs can be utilized to couple the container 12 with the bracket 34.

In addition to the arms 40 described above, one or more additional portions of the bracket 34 can extend from the wall surface 36 to support the container 12 when pressed by a user to dispense material therefrom. For example, the bracket 34 shown in FIGS. 1 and 2 includes a back support 46 coupled to the plate 38 and extending generally away from the wall surface 36. The back support 46 can be coupled to the plate 38 in any suitable manner, including without limitation being integral with the plate 38 (e.g., formed of the same piece of material as the plate 38), coupled to the plate 38 with elements that inter-engage with the plate 38, coupled to the plate 38 with fasteners, adhesive or cohesive bonding material, and the like. The back support 46 can have any shape suitable for providing support for the container 12 against a compressive force by a user pressing against the container 12. In the illustrated embodiment, the back support 46 includes a first arm 48 and a second arm 50 that extend toward the container 12, and a third arm 52 joining first and second arms 48, 50 and spaced from the plate 38. In some embodiments, the container 12 abuts the third arm 52 when the container 12 is in a rest position, as shown in FIG. 2. The third arm 52 of the illustrated back support 46 contacts the container 12 between the top surface 14 and the bottom surface 16

In other embodiments, the back support 46 takes other shapes, including without limitation a round or rotund loop of resilient material coupled to or defined by the plate 38, a leaf spring or other type of spring positioned behind the container 12, a bowed, wave-shaped or arc-shaped portion of the plate 38 behind the container 12, an extension of either or both arms 40 holding the container 12, and the like.

The back support 46 is resilient, such that when the container 12 is pressed against the back support 46, the back support 46 exerts a reactionary force against the container 12, and returns to its original shape (or substantially its original shape) after removal of the force against the container 12. The back support 46 can be utilized to assist in dispensing material from the container 12, such as by causing the container 12 to be squeezed between the user and one or more surfaces of the back support 46 to dispense material from the container 12. The user can press against the container 12 with a hand, arm, elbow, shoulder, knee, foot, and the like. The back support 46 permits a user to easily dispense material from the container 12 without requiring that the user grip the container 12. This can be desirable in locations such as butcher shops, hospitals, clinics, and other locations where a user's hands should not be used to contact the container 12 or other portion of the dispenser 10. The dispenser 10 of the illustrated embodiment of FIGS. 1 and 2 permits a user to press against the container 12 with another body part (e.g., wrist, arm, elbow, shoulder, knee, and/or foot) to dispense material from the container 12.

The container 12 illustrated in FIGS. 1 and 2 is rotatably coupled to the bracket 34, such that a user can rotate the container 12 away from the back support 46 and squeeze the front and rear surfaces 18 and 20 of the container together to dispense material from the container 12. Such a capability enables a user preferring to have potentially greater material dispense control the ability to squeeze the container 12 between the user's fingers with a desired force and for a desired length of time. Also, the rotatable connection between the container 12 and bracket 34 permits easy cleaning of the container 12, bracket 34, and wall surface 36 (especially in those embodiments in which the footprint of the bracket 34 on the wall surface 36 is significantly smaller than that of the container 12), and/or easy refilling or replacement of the container 12. Improved cleanability is particularly desirable in locations where the container 12 and bracket 34 are exposed to bacteria or other pathogens, dirt, dust, debris, and residue (such as in butcher shops and hospitals) and/or where the container 12 and bracket 34 are in public view such that discoloration or the presence of dirt, dust, debris, and residue is undesirable.

The container 12 of the embodiment illustrated in FIGS. 1 and 2 can be removed from the bracket 34 by unlocking and moving the second portion 37 of the bracket 34 as discussed in greater detail above. In other embodiments, the container 12 can be removed from the bracket 34 by bending one of the arms 40 away from the container 12 and/or by releasing another locking mechanism (not shown) to permit one of the arms 40 to pivot outward. The container 12 can be recycled, refilled and/or replaced when the container 12 becomes empty.

Figure 3:
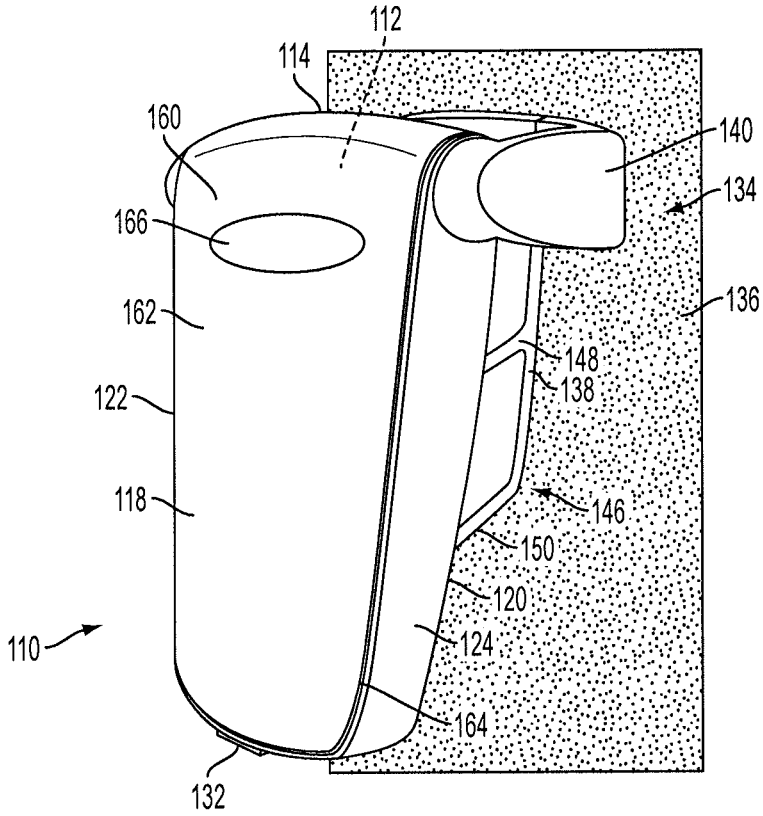
FIG. 3 is a perspective view of the dispenser of FIG. 1, shown with a cover.

FIG. 3 illustrates another embodiment of dispenser according to the present invention. This embodiment employs much of the same structure and has many of the same properties as the embodiments of the dispenser 10 described above in connection with FIGS. 1 and 2. Accordingly, the following description focuses primarily upon structure and features that are different than the embodiments described above in connection with FIGS. 1 and 2. Reference should be made to the description above in connection with FIGS. 1 and 2 for additional information regarding the structure and features, and possible alternatives to the structure and features of the dispenser 110 illustrated in FIG. 3 and described below. Features and elements in the embodiment of FIG. 3 corresponding to features and elements in the embodiments described above in connection with of FIGS. 1 and 2 are numbered in the 100 series of reference numbers.

Like the dispenser 10 illustrated in FIGS. 1 and 2, the dispenser 110 illustrated in FIG. 3 includes a bracket 134 having a back support 146 coupled to a plate 138 and having a first arm 148 and a second arm 150 that extend away from a wall surface 136. The illustrated back support 146 includes a third arm (similar to third arm 52 shown in FIG. 2) joining the first arm 148 and the second arm 150 and spaced from the plate 138.

The dispenser illustrated in FIG. 3 includes a cover 160 coupled to the container 112. The cover 160 includes a face plate 162 and a perimeter 164 wall. The illustrated cover 160 substantially covers the front surface 118, top surface 114, and the first and second side surfaces 122, 124 of the container 112. In other embodiments, the cover 160 substantially covers only the front surface 18 of the container 112, or any combination of the front surface 118 with the top surface 114, bottom surface 116, first side surface 122, second side surface 124, and/or rear surface 120. In some embodiments, at least a portion of the bottom surface 116 is uncovered to permit dispensing of material through a dispensing outlet 132.

The cover 160 can comprise any material desired, including without limitation metal, plastic, wood, fiberglass, and the like, and in some embodiments can have different portions made of different materials. By way of example only, the cover 160 can be made entirely of plastic. However, in some embodiments, such as FIG. 3, the cover can be made of a plastic overlaid with a sheet of metal defining the face plate 162. In the illustrated embodiment of FIG. 3, the plastic portion of the cover 160 substantially covers the front surface 118, top surface 114, and the first and second side surfaces 122, 124 of the container 112, and is molded to the metal face plate 162, which substantially cover the front and top surfaces 118, 114 of the container 112. In other embodiments, the metal portion of the cover 160 is coupled to the rest of the cover 160 in any other suitable manner, such as by adhesive or cohesive bonding material, clips or other fasteners, a snap fit, and the like.

Although the cover illustrated in FIG. 3 is made of plastic and a face plate 162 of metal, other types of material combinations are possible, including without limitation a plastic portion substantially covering the front 118, top surface 114, and the first and second side surfaces 122, 124 of the container 112, and a face plate 162 made of a wood, fiberglass, stone, ceramic, or other material.

With continued references to the cover 160 illustrated in FIG. 3, the cover 160 can include indicia 166, such as the illustrated Branding. Indicia 166 can illustrate a specific brand name or symbol, instructions for use, or any other information desired. Any combination of branding and cover colors, shades, and textures can be used as desired. For example, as an alternative to printing the indicia 166 on the cover, the indicia 166 can be carved, stamped, pressed, machined, molded, or embossed into the cover 160 to be recessed within or elevated above the surrounding portions of the cover 160.

As another example, such as with a transparent or translucent plastic or glass cover 160, the indicia 166 is printed on a rear side of the face plate 162. The illustrated indicia 166 is shown in a dark color that contrasts with the light color of the underlying layer, although any combination of colors, shades, and textures can be used as desired.

As described above in connection with the embodiments of FIGS. 1 and 2, the back support 146 is resilient, such that when the container 112 and respective cover 160, 180 are pressed up against the back support 146, the back support 146 provides a reactionary force to squeeze the container 112 between the user and the back support 146. As such, the back support 146 can be utilized to assist in dispensing material 128 from the container 112.

The container 112 illustrated in FIG. 3 is coupled to the cover 160 for pivotable movement with respect to the bracket 134. In this regard, the cover 160 sufficiently surrounds and is sufficiently engaged with the container 112 to move the container 112 upon movement of the cover 160. For example, the cover 160 illustrated in FIG. 3 substantially surrounds the front surface 118, top surface 114, and the first and second side surfaces 122, 124 of their respective containers 112, and by such engagement cause movement of the containers 112 when their respective covers 160 are moved. In some embodiments, the cover 160 grips one or more portions of the container 112 for this purpose, or is releasably attached to one or more portions of the container 112 in a manner causing the container 112 to move with the cover 160. Accordingly, a user can rotate the container 112 away from the back support 146 and squeeze the cover 160, 180 and container 112 between his or her fingers, which in turn squeezes the front and rear surfaces 118 and 120 of the container 112 together to dispense material from the container 112.

The covers 160 described above can permit easy cleaning of the dispenser 110 and replacement or refilling of spent containers 112. This can be desirable in locations where the container 112, cover 160, and bracket 134 are exposed to significant bacteria or other pathogens, dirt, dust, debris, or residue, such as in butcher shops, hotel rooms, and hospitals, and/or where the container 112, cover 160, 180 and bracket 134 are in public view such that discoloration or the presence of dirt, dust, debris, or residue is particularly undesirable.

The container 112 illustrated in FIG. 3 can be removed from the cover 160 by disengaging the containers 112 from the brackets 134 as described above, and pulling the container 112 out of the cover 160. The container 112 can be recycled, refilled and/or replaced when the container 112 becomes empty.

By virtue of the relationship between the container 12, 112 and bracket 34, 134 in the dispenser embodiments described above and illustrated in FIGS. 1-3, it will be appreciated that some embodiments of the dispensers 10, 110 can be actuated in multiple manners, such as by a user pressing a portion of the user's body (e.g., hand, wrist, arm, and the like) against the dispenser to dispense material from the container 12, 112, and/or by a user rotating the container 12, 112 (with cover 60, 160, if use) away from the bracket 34, 134 and squeezing the container 12, 112. This versatility presents significant advantages to users wishing to operate the dispenser 34, 134 in different manners, and provides for a dispenser 34, 134 that is well-suited for different applications and environments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. Various features and advantages of the invention are set forth in the following claims.

What is claimed is:

1. A dispenser adapted for mounting on a surface, the dispenser comprising:

a bracket having two arms extending in a direction away from the surface; and a container rotatably coupled to the arms a distance from the surface, the container having an exposed front facing generally away from the surface, a rear facing generally toward the surface, an exposed top and bottom extending between and connecting the front and rear of the container, exposed opposite sides extending between and connecting the front and rear of the container, and an outlet through which material from within the container is dispensed;

the container having a rest position in which the container is oriented with the outlet facing in a substantially downward direction, the container pivotable with respect to the bracket toward and away from the rest position, wherein the two arms releasably engage the container proximate the top to define a rotatable connection, and wherein the container is pivotable about an axis extending through the arms and the container.

2. The dispenser of claim 1, wherein the container is removably coupled to the bracket.

3. The dispenser of claim 1, wherein the container is pivotably coupled to the bracket proximate a top end of the container.

4. A dispenser adapted for mounting on a surface, the dispenser comprising:

a bracket having at least one arm extending in a direction away from the surface;

a container rotatably coupled to the arm a distance from the surface; the container having a front facing generally away from the surface, a rear facing generally toward the surface, a top and bottom extending between and connecting the front and rear of the container, opposite sides extending between and connecting the front and rear of the container, and an outlet through which material from within the container is dispensed, the container releasably and rotatably coupled to the bracket via mating engagement between the container and the at least one arm of the bracket, the container having a rest position in which the container is oriented with the outlet facing in a substantially downward direction, the container pivotable with respect to the bracket toward and away from the rest position; and a cover coupled to the container and substantially covering the front of the container, the cover coupled to the bracket via the container.

5. The dispenser of claim 4, wherein the cover substantially covers the opposite sides of the container.

6. The dispenser of claim 4, wherein the container is pivotably coupled to the bracket proximate a top end of the container.

7. A dispenser operable to contain and selectively dispense material, the dispenser comprising:

a container including:

a first end having at least one of a protrusion and a recess, a second end spaced from the first end and having an outlet, a front surface, a rear surface, and a cavity defined between the front and rear surfaces of the container and adapted to contain a material to be dispensed from the dispenser;

a bracket including at least one of a recess and a protrusion matingly engaging the at least one of the protrusion and the recess of the container, respectively, to rotatably couple the container to the bracket and to support the container on a surface, the bracket further including a projection extending toward the container from the surface and supporting the container when pressed by a user; and a cover at least partially covering the container, the cover coupled to the container to lift the container upon rotation of the cover away from the bracket.

8. The dispenser of claim 7, wherein the cover substantially covers a front surface, top surface, and side surfaces of the container.

9. The dispenser of claim 7, further comprising indicia on the cover.

10. The dispenser of claim 7, wherein the container is coupled to the bracket by a pair of arms extending toward the container away from the surface.

11. The dispenser of claim 7, wherein the container is pivotably coupled to the bracket proximate a top end of the container.

12. The dispenser of claim 7, wherein the cover is coupled to the bracket via the container.

13. A mounting system for securely mounting a selectively removable dispensable container to a surface, the mounting system comprising:

a container having a first projection and a second projection, wherein the first Projection is aligned with the second projection to define an axis of rotation for the container; and a bracket comprising a first arm having a recess for receiving the first projection and a second arm having a recess for receiving the second projection, wherein the first arm is selectively moveable away from the second arm, and wherein the bracket includes a resilient back support exerting a reactionary force against the container in response to a compressive force applied to the front of the container to dispense material from the container.

* * * * *

UNITED STATES PATENT AND TRADEMARK OFFICE

CERTIFICATE OF CORRECTION

PATENT NO. : 8,690,018 B2
APPLICATION NO. : 13/318414
DATED : April 8, 2014
INVENTOR(S) : Lambertus van der Heijden, Arnoud Gengler and Bekie Riley It is certified that error appears in the above-identified patent and that said Letters Patent is hereby corrected as shown below:

Title page, Column 1, under item [87] should read: -- (60) Related U.S. Application Data Continuation of application No. 61/176,102, filed on May 6, 2009, now expired. --

Signed and Sealed this
Fifth Day of May, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,690,018 B2
APPLICATION NO. : 13/318414
DATED : April 8, 2014
INVENTOR(S) : van der Heijden et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 35 days.

Signed and Sealed this
Twenty-ninth Day of September, 2015

Michelle K. Lee

Michelle K. Lee
*Director of the United States Patent and Trademark Office*